US007753059B2

(12) United States Patent
Hasegawa

(10) Patent No.: US 7,753,059 B2
(45) Date of Patent: Jul. 13, 2010

(54) FLUID EJECTION GUN AND CLEANING APPARATUS USING THE SAME

(75) Inventor: Kaga Hasegawa, Tokyo (JP)

(73) Assignee: GA-REW Corporation (JP)

( * ) Notice: Subject to any disclaimer, the term of this patent is extended or adjusted under 35 U.S.C. 154(b) by 232 days.

(21) Appl. No.: 11/908,098

(22) PCT Filed: Sep. 21, 2005

(86) PCT No.: PCT/JP2005/017411

§ 371 (c)(1),
(2), (4) Date: Sep. 7, 2007

(87) PCT Pub. No.: WO2006/095466

PCT Pub. Date: Sep. 14, 2006

(65) Prior Publication Data

US 2009/0078293 A1 Mar. 26, 2009

(30) Foreign Application Priority Data

Mar. 8, 2005 (JP) ..... 2005-063685

(51) Int. Cl.
*B08B 3/02* (2006.01)

(52) U.S. Cl. ..... 134/109

(58) Field of Classification Search ..... 134/109
See application file for complete search history.

(56) References Cited

U.S. PATENT DOCUMENTS

| | | | | |
|---|---|---|---|---|
| 2,417,222 | A | 3/1947 | C. A. Stine | |
| 4,563,840 | A | 1/1986 | Urakami | |
| 2003/0029933 | A1 * | 2/2003 | Hasegawa | 239/416.5 |
| 2004/0149836 | A1 | 8/2004 | Herhold | |

FOREIGN PATENT DOCUMENTS

| | | | |
|---|---|---|---|
| GB | 1331064 | | 9/1973 |
| JP | 10-286494 | A | 10/1998 |
| JP | 11-123350 | | 5/1999 |
| JP | 2000-117211 | | 4/2000 |
| JP | 2001-104840 | A | 4/2001 |
| JP | 2001104840 | * | 4/2001 |

(Continued)

OTHER PUBLICATIONS

Machine translations of JP 2000-117211.*

(Continued)

*Primary Examiner*—Frankie L Stinson
*Assistant Examiner*—Samuel A Waldbaum
(74) *Attorney, Agent, or Firm*—Cantor Colburn LLP

(57) ABSTRACT

A fluid ejection gun includes: a flexible ejection tube for ejecting a fluid, the fluid being supplied to the inside of the ejection tube, the fluid being ejected from the tip of the ejection tube; a guide disposed to surround the ejection tube and introduce the ejection tube along the inner surface of the guide, the ejection tube being moved by the fluid ejected from the tip of the ejection tube; a casing disposed to surround the guide, the casing having an opening section forward in the ejection direction of the fluid ejected from the tip of the ejection tube; and a suction unit provided to the casing for sucking the fluid ejected from the ejection tube.

9 Claims, 5 Drawing Sheets

FOREIGN PATENT DOCUMENTS

WO 96/13333 A1 5/1996

OTHER PUBLICATIONS

Machine translation of JP 11-123350.*
Machine translation for JP 2001-104840 (Apr. 2001).*
International Search Report for International Application No. PCT/JP2005/017411 mailed Nov. 1, 2005.
European Search Report for Application No. 05785911.8 - 1253/1857190 PCT/JP2005017411 mailed Apr. 28, 2010.

* cited by examiner

FLUID EJECTION GUN AND CLEANING APPARATUS USING THE SAME

CROSS REFERENCE TO RELATED APPLICATIONS

This is a U.S. national stage of application No. PCT/JP2005/017411, filed on 21 Sep. 2005. Priority under 35 U.S.C. §119(a) and 35 U.S.C. §365(b) is claimed from Japanese Application No. 2005-063685, filed 8 Mar. 2005, the disclosure of which is also incorporated herein by reference.

TECHNICAL FIELD

The present invention relates to a fluid ejection gun and a cleaning apparatus using the same.

The present application is based on patent application No. 2005-063685 filed Mar. 8, 2005, in Japan, the content of which is incorporated herein by reference.

BACKGROUND ART

Conventional cleaning apparatuses are known for cleaning a textile surface of a sofa or compartment seat that is not easily removable from a compartment. Cleaning apparatuses of this kind eject a fluid, e.g., air or water pumped from a high-pressure compressor onto a surface of an object being cleaned to blow off dirt or dust.

Some cleaning apparatuses of the foregoing kind are provided with a fluid ejection gun that is provided with an elastic cylindrical nozzle and a circular guide disposed outside of the nozzle. The cleaning apparatus amplifies the pressure wave of the fluid by supplying the fluid to the nozzle to provide high-speed rotation to the nozzle along the inner surface of the guide; thus ejecting the fluid having more significant spurting force (see, for example, a patent document 1).

[Patent Document 1] Japanese Unexamined Patent Application, First Publication No. H11-123350

DISCLOSURE OF INVENTION

Problems to be Solved by the Invention

Since ejecting high-pressure fluid from the nozzle of the cleaning apparatus using the foregoing fluid ejection gun brushes dirt or dust, the removed dirt or the brushed dust is inevitably fluttered around the object being cleaned. On the contrary, reducing the spurting force of the fluid in order to prevent the dust from fluttering underpowers the cleaning capability. In addition, combined use of the fluid ejection gun and a vacuum apparatus for blowing the fluid onto the object being cleaned while suctioning the dirt or dust overloads the operator who has to operate two apparatuses simultaneously.

The present invention was conceived in consideration of the foregoing problems, and provides a cleaning apparatus that can reduce the workload of the operator and improve the cleaning capability while preventing dirt and dust from fluttering.

Means for Solving the Problems

The present invention provides a fluid ejection gun that includes: a flexible ejection tube for ejecting a fluid, the fluid being supplied to the inside of the ejection tube, the fluid being ejected from the tip of the ejection tube; a guide disposed to surround the ejection tube and introduce the ejection tube along the inner surface of the guide, the ejection tube being moved by the fluid ejected from the tip of the ejection tube; a casing disposed to surround the guide, the casing having an opening section forward in the ejection direction of the fluid ejected from the tip of the ejection tube; and a suction unit provided to the casing for suctioning the fluid ejected from the ejection tube.

According to the fluid ejection gun of the present invention, compressing the opening section of the casing onto a surface of an object being cleaned and ejecting a fluid from the tip of the ejection tube cause the tip of the ejection tube to swing along the inner surface of the guide with a reactive force of the ejected fluid. The swinging tip of the ejection tube causes the fluid to be blown onto the surface of the object being cleaned so that the blown fluid makes a circular path, thereby brushing dirt or dust from the object being cleaned effectively. In addition, confining the dust, etc., brushed from the object being cleaned in the casing prevents the dust from fluttering therearound.

According to the fluid ejection gun of the present invention, it is preferable that the suction unit further includes an exhaust tube communicating to the casing; and a dust-collecting unit communicating to the exhaust tube for collecting dust in the fluid. In addition, it is preferable that the suction unit supplies a part of the fluid from the inside of the ejection tube to the dust-collecting unit in the exhaust tube.

According to the fluid ejection gun of the present invention, ejecting a part of the fluid supplied to the inside of the ejection tube toward the dust-collecting unit in the exhaust tube generates a fluid flow toward the dust-collecting unit in the exhaust tube. This fluid flow causes the fluid containing dirt or dust in the casing to be suctioned through the exhaust tube and flown into the dust-collecting unit. Therefore, the dust, etc., brushed from the object being cleaned can be collected effectively.

The present invention provides a cleaning apparatus that includes: a flexible ejection tube for ejecting a fluid, the fluid being supplied to the inside of the ejection tube, the fluid being ejected from the tip of the ejection tube; a fluid-pumping unit for pumping the fluid to the inside of the ejection tube; a guide disposed to surround the ejection tube and introduce the ejection tube along the inner surface of the guide, the ejection tube being moved by the fluid ejected from the tip of the ejection tube; a casing disposed to surround the guide, the casing having an opening section forward with respect to the ejection direction of the fluid ejected from the tip of the ejection tube; and a suction unit provided to the casing for suctioning the fluid ejected from the ejection tube.

According to the cleaning apparatus of the present invention, compressing the opening section of the casing onto a surface of an object being cleaned and ejecting a fluid from the tip of the ejection tube cause the tip of the ejection tube to swing along the inner surface of the guide with a reactive force of the ejected fluid. The swinging tip of the ejection tube causes the fluid to be blown onto the surface of the object being cleaned so that the blown fluid makes a circular path, thereby brushing dirt or dust from the object being cleaned effectively. In addition, confining the dust, etc., brushed from the object being cleaned in the casing prevents the dust from fluttering therearound.

In the cleaning apparatus of the present invention, it is preferable that the suction unit further includes an exhaust tube communicating to the casing; and a dust-collecting unit communicating to the exhaust tube for collecting dust in the fluid. In addition, it is preferable that the suction unit supply a part of the fluid from the inside of the ejection tube to the dust-collecting unit in the exhaust tube.

According to the cleaning apparatus of the present invention, ejecting part of the fluid from the inside of the ejection tube to the dust-collecting unit in the exhaust tube generates a fluid flow toward the dust-collecting unit in the exhaust tube. This fluid flow causes the fluid containing dirt or dust in the casing to be suctioned through the exhaust tube and flown into the dust-collecting unit. Therefore, the dust, etc., brushed from the object being cleaned can be collected effectively.

EFFECTS OF THE INVENTION

The present invention can prevent the dust, etc., from fluttering more reliably than in a case where a conventional vacuum apparatus is concurrently used. Therefore, effects can be obtained for reducing an operator's workload and enhancing the marketability of the product. In addition, a cost-reducing effect can be obtained due to a vacuum-apparatus-free structure.

EXPLANATION OF REFERENCE NUMERALS AND SYMBOLS

13: ejection nozzle (ejection tube)
14: branch pipe (suction unit)
16: branch socket (suction unit)
18: guide
19: case (casing)
20: opening section
24: exhaust tube (suction unit)
26: filter (suction unit)

BEST MODE FOR CARRYING OUT THE INVENTION

A first embodiment of the present invention is explained with reference to the drawings.

Figure 1:
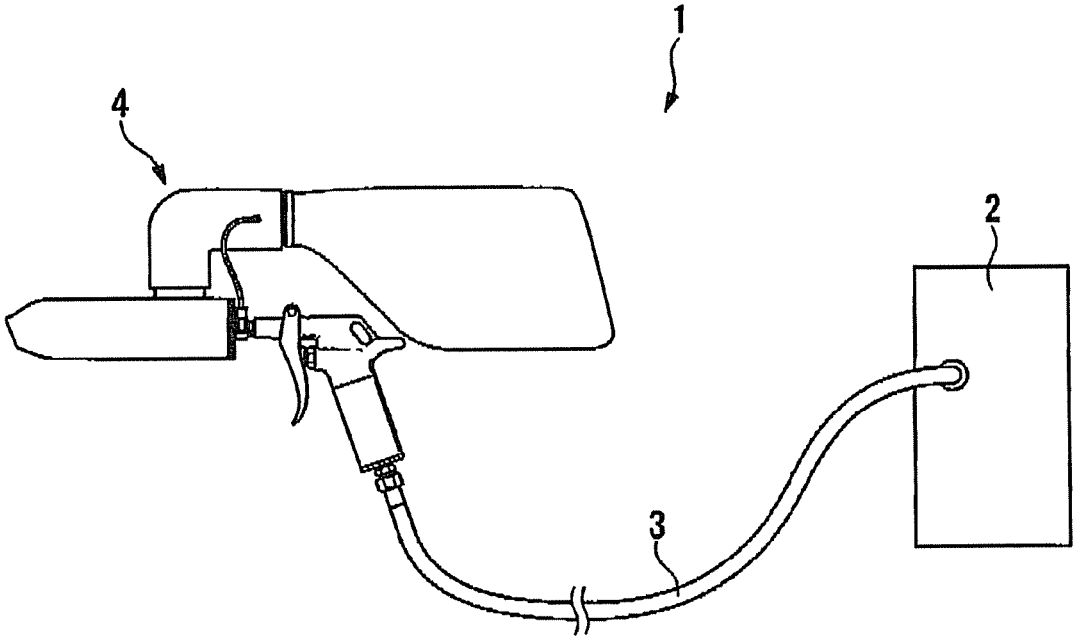
FIG. 1 shows a cleaning apparatus in schematic view according to a first embodiment of the present invention.

As illustrated in FIG. 1, a cleaning apparatus 1 includes: a compressor 2 for pumping a pressurized fluid, e.g., air or water; and an ejection gun 4, connected to the compressor 2 via a hose 3, for ejecting the fluid supplied by the compressor 2. Carrying out cleaning includes pumping the fluid from the compressor 2, and ejecting the fluid from the ejection gun 4 held by an operator onto a surface of an object being cleaned while moving the ejection gun 4 inch by inch.

Figure 2:
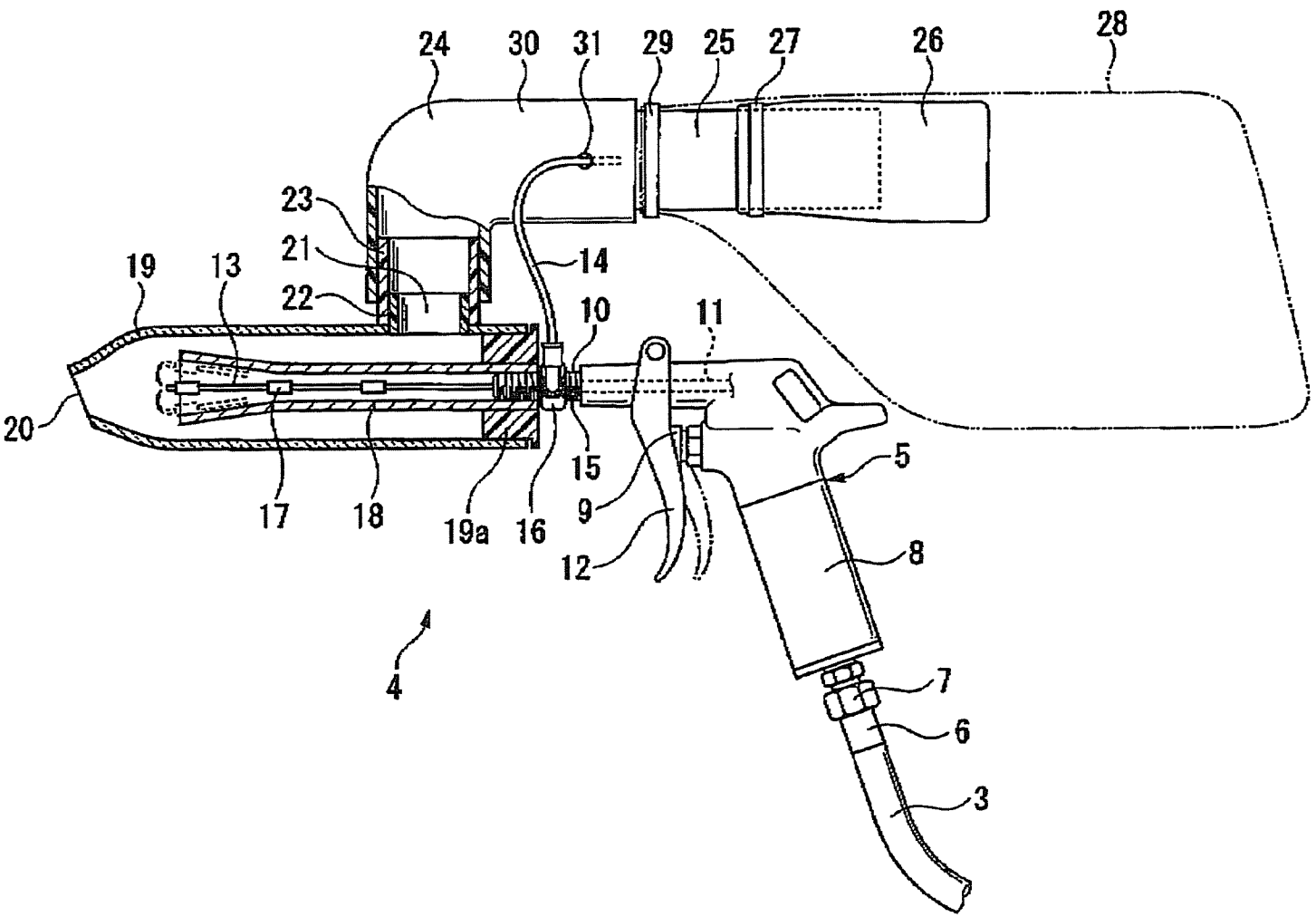
FIG. 2 shows a part of an ejection gun in cross sectional view according to the first embodiment of the present invention.

As illustrated in FIG. 2, the ejection gun 4 is provided with a gun body 5. A hose 3 is connected to an entrance port 7 of the gun body 5 via a connector 6. A grip section 8 is provided above the entrance port 7. A trigger switch 9 is provided above the grip section 8 so that the trigger switch 9 protrudes in front of the grip section 8.

An exit path 11 extending forward is formed above the gun body 5. An exit port 10 is disposed at the front end of the exit path 11. In addition, a trigger lever 12 pending in front of the grip section is provided above the gun body 5. The trigger lever 12 is supported at the upper end of the gun body 5 and capable of freely rotating there. Usually, the trigger lever 12 is urged forward by the trigger switch 9 so that the entrance port 7 is disconnected from the exit port 10. Dragging the trigger lever 12 toward the grip section 8 pushes the trigger switch 9 and communicates the entrance port 7 to the exit port 10; thereby supplying the fluid pumped through the hose 3 to an ejection nozzle 13 or a bypass tube 14, that will be explained later, through the exit port 10.

An attachment screw section 15 is formed on an outer periphery of the exit port 10 of the exit path 11. A branch socket (suction unit) 16 is engaged with the attachment screw section 15 for branching the fluid pumped from the gun body 5. An ejection nozzle (ejection tube) 13 and a bypass tube (suction unit) 14 are connected to the branch socket 16. The ejection nozzle 13 is cylindrical and has substantially a constant thickness. The ejection nozzle 13 is entirely made from plastic material, e.g., nylon, Teflon (Trade Mark Registered), polyurethane, or polypropylene. A plurality of synthetic resin guide bodies 17 are disposed on the outer circumference of the ejection nozzle 13 at a predetermined interval along the longitudinal direction of the ejection nozzle 13. The guide bodies 17 making contact with a guide 18, which will be explained later, prevent the ejection nozzle 13 from wearing out while the ejection nozzle 13 swings along the guide 18.

The metal-made guide 18 for guiding the ejection nozzle 13 is disposed around the ejection nozzle 13. The guide 18 has a cone shape so that an inner diameter thereof gradually increases from the branch socket 16 to the forward relative to the ejection gun 4. A branch socket 16 is screwed into a base portion of the guide 18. A case (casing) 19 is attached to the outer periphery of the guide 18 via a bottom-section-supporting member 19*a*. The substantially cylindrical case 19 is made from engineering plastics.

The case 19 has an oval opening section 20 in the ejection direction, i.e., forward relative to the ejection nozzle 13. A portion of the case 19 closer to the opening section 20 is more compressed vertically. The upper portion of the case 19 slightly protrudes forward of the bottom portion of the case 19. Material forming the guide 18 may not be limited to metal as long as it is hard and has low friction resistance. Therefore using lighter material is advantageous because of improved operability of the ejection gun 4.

The opening section 20 is a horizontal oval hole in order to obtain a larger cleaning area since the ejection gun 4 according to the present embodiment is assumed to be used vertically. In addition, the opening section may be a vertical oval hole in a case where the ejection gun is moved horizontally. That is, the shape of the opening section 20 may be determined in accordance with the operation direction of the ejection gun 4.

An exhaust port 21 is formed above the base portion of the case 19. An exhaust tube (suction unit) 24 is connected to the exhaust port 21 via cylindrical joints 22 and 23. The exhaust tube 24 bends in an L-letter shape, that is, standing vertically and bending backward relative to the ejection direction. A filter attachment section 25 having a smaller diameter than an outer diameter of the exhaust tube 24 is formed at a rear end of the exhaust tube 24 so as to extend backward relative to the ejection direction. A filter (suction unit) 26 is fixed to the filter attachment section 25. The filer 26 is tightened to the filter attachment section 25 by a resin-made tie-band 27. A fabric cover 28 is fixed to the filter attachment section 25 to cover the filer 26. The cover 28 is fixed to the filter attachment section 25 by a metal band 29. A fastener, which is not shown in the drawing, is formed beneath the cover 28. Opening the fastener allows the filer 26 to be exchanged without removing the cover 28 from the filter attachment section 25. The filer 26 disposed backward relative to the fixed position of the cover 28 is fixed to the filter attachment section 25. Meanwhile, only the filer 26 may be used without the cover 28.

A horizontal section 30 extending backward relative to the ejection direction constitutes the bending exhaust tube 24 having an L-letter shape. A hole 31 is formed on a side wall of the horizontal section 30. An end of the bypass tube 14 is inserted through the hole 31. The other end of the bypass tube 14 is connected to a branch socket 16. To be more specific, the end of the bypass tube 14 is inserted from the hole 31 through the exhaust tube 24 so that the opening of the tip is fixed toward the filer 26 disposed at an exhaust port of the exhaust tube 24. Ejection of the fluid from the bypass tube 14 to the filer 26 causes a fluid flow toward the filer 26 inside of the exhaust tube 24, and this results in reducing the pressure in the vicinity of the exhaust port 21 relative to the vicinity of the opening section 20 of the case 19.

In the above explained first embodiment, the operator compresses the opening section 20 of the case 19 onto the surface of the object being cleaned, e.g., a compartment seat, and then draws the trigger lever 12 of the gun body 5. The fluid pumped from the compressor 2 is then supplied to the inside of the ejection nozzle 13 and ejected from the tip thereof. Ejecting the fluid from the ejection nozzle 13 introduces the ejection nozzle 13 within the cone-shaped guide 18 and swings the ejection nozzle 13 so that the tip of the ejection nozzle 13 rotating outward relative to the ejection direction makes a circular path. This results in allowing the fluid to be dispersed in a cone-shape and ejected toward the surface of the object being cleaned, thereby amplifying the pressure wave of the fluid and ejecting the fluid having a more significant spurting force.

Dirt or dust brushed from the surface of the object being cleaned, e.g., a compartment seat with the fluid ejected in a cone-shape from the tip of the ejection nozzle 13 is confined in the case 19 since the opening section 20 of the case 19 is compressed onto the surface of the object being cleaned. Therefore, dust, etc., will not flutter in the exterior thereof.

Since the cleaning apparatus 1 according to the present embodiment is capable of carrying out cleaning works while facilitating the movement of the ejection nozzle 13, it is capable of cleaning the surfaces of hardly movable and non-machine-washable objects being cleaned, e.g., a seat or a sofa of a compartment like an automobile.

In addition, in the present embodiment, the fluid pumped from the compressor 2 to the ejection nozzle 13 is utilized efficiently. So merely introducing the fluid to the exhaust tube 24 through the bypass tube 14 can cause a fluid flow to the filer 26 in the exhaust tube 24, thereby immediately introducing dust, etc., confined in the case 19 to the exhaust tube 24 from the exhaust port 21 without leaking them from the exterior of the case 19. This results in allowing only the fluid to be exhausted to the exterior of the ejection gun 4 and collecting only the dust, etc. by the filer 26.

Dirt or dust accumulating in the filer 26 will not impair the appearance of the ejection gun 4 since the filer 26 is covered with the fabric cover 28 significantly larger than the filer 26. Furthermore, the readily exchangeable filer 26 reduces the workload for the operator and prevents the suction force from dropping due to the clogging of the filer 26.

The guide body 17 provided to the ejection nozzle 13 can prevent the ejection nozzle 13 from wearing and lower the exchange frequency of the ejection nozzle 13, thereby reducing maintenance costs.

Furthermore, unifying the ejection nozzle 13 for ejecting the fluid with the exhaust tube 24 for suctioning dust, etc., via the case 19 can reliably prevent the dust, etc., from fluttering while the operator conducts cleaning work with one hand. This results in further reducing the workload for the operator and enhances the marketability of the product.

A second embodiment will be explained next based on FIG. 3. It should be noted that, in the second embodiment, the exhaust tube 24 that was explained in accordance with the above first embodiment is disposed coaxially with the case 19. Structural elements that are equivalent to those of the first embodiment will be assigned the same numeric symbols and redundant explanations thereof will be omitted.

Figure 3:
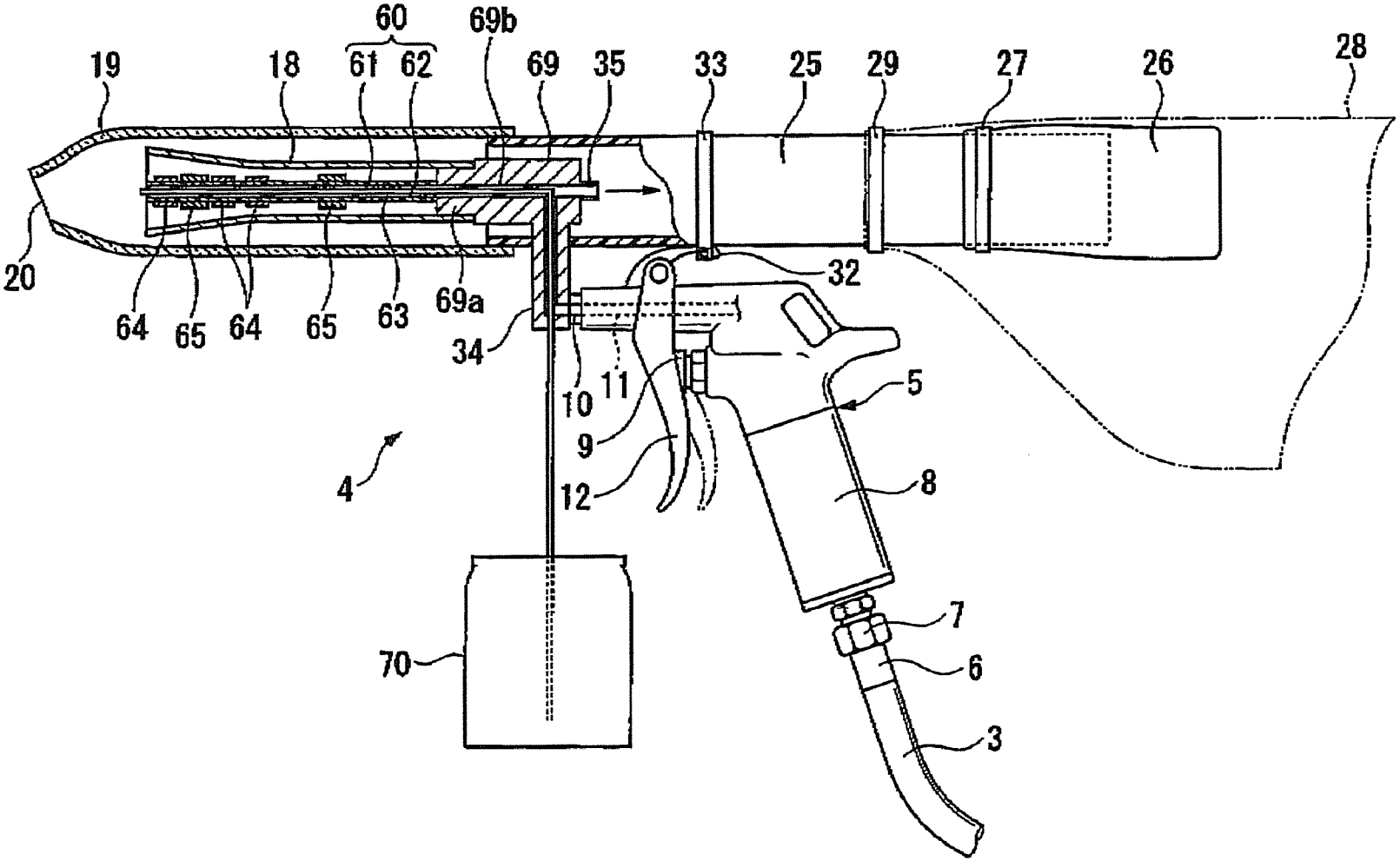
FIG. 3 shows a part of an ejection gun in cross sectional view according to a second embodiment of the present invention.

As illustrated in FIG. 3, the ejection gun 4 is provided with the gun body 5 that is capable of being switched, i.e., selectively opening and closing an inner path by means of the trigger lever 12. A support section 32 for supporting the exhaust tube 24 is formed above the gun body 5. The thickness of the end of the support section 32 tapers down backward relative to the ejection direction. The fixed portion of the support section 32 is substantially in parallel with the exhaust tube 24.

A branch socket 69 is connected to the exit port 10 of the gun body 5 via a tubing 34 extending vertically upward. An airflow path 69*b* in the branch socket 69 divides in two directions. One of the divided paths is formed forward relative to the gun body 5, and the other one is formed backward relative to the gun body 5. An ejection nozzle 60 having a dual-wall structure, which will be explained later, is connected to the of the divided paths. An ejection port 35 disposed toward the exit of the exhaust tube 24 is formed to the latter of the divided paths.

Similarly to the first embodiment, the cylindrical guide 18 is disposed around the ejection nozzle 60. The case 19 is disposed outside the guide 18. The cylindrical exhaust tube 24 is inserted from the backside through the case 19 and fixed there. Fixing the exhaust tube 24 to the support section 32 by means of the attachment band 33 supports the exhaust tube 24 on the gun body 5.

The ejection nozzle 60 is provided with a tubular outer nozzle 61 and a tubular inner nozzle 62 inserted through the outer nozzle 61. The outer nozzle 61 is entirely made from plastic material like synthetic resin, e.g., nylon, Teflon (Trade Mark Registered), polyurethane, or polypropylene. In addition, at least the portion of the inner nozzle 62 disposed inside the outer nozzle 61 is also made from plastic material like synthetic resin.

One of the ends of the inner nozzle 62 slightly protrudes from the tip of the outer nozzle 61. The other end of the inner nozzle 62 is connected to a liquid reservoir 70 disposed separately. The liquid reservoir 70 stores the non-compressed state of liquid. In the present case, the liquid reservoir 70 stores cleaning liquid.

The base portion of the outer nozzle 61 is attached to an attachment section 69*a* of the branch socket 69. The inner nozzle 62 is inserted through the outer nozzle 61. An airflow path 69*b* that communicates with a space 63 between the outer nozzle 61 and the inner nozzle 62 is formed in the branch socket 69.

A plurality of synthetic-resin-made and weighted sections 64 are fixed on outer peripheries of the outer nozzle 61. A rotative guide body 65 is disposed between the weighted sections 64.

The weighted sections 64 add weight to the tip of the ejection nozzle 60 so as to cause efficient rotating movement of the ejection nozzle 60 along the guide 18. The guide bodies 65, principally making contact with the guide 18 prevent the dual nozzle structure from wearing out while the ejection nozzle 60 swings along the guide 18. The guide 18 is screwed onto the attachment section 69*a* of the branch socket 69.

The trigger lever 12 of the gun body 5 drawn by the operator causes the air pumped from the compressor 2 to be ejected from the tip of the ejection nozzle 60 through the airflow path 69*b* of the branch socket 69 followed by the space 63 formed between the outer nozzle 61 and the inner nozzle 62. The ejection nozzle 60 guided by the guide 18 swings so that the tip of the ejection nozzle 60 makes a circular path. On the other hand, ejecting the air outward from the tip of the ejection nozzle 60 through the space 63 reduces the pressure in the vicinity of the opening section on an end of the inner nozzle 62, thus sucking the cleaning liquid from the liquid reservoir 70 through the inner nozzle 62 to produce a mixture of the air and the cleaning liquid. This causes mist mixture of the air and the cleaning liquid to be ejected in a cone-shape from the tip of the ejection nozzle 60. In addition, swinging ejection nozzle 60 intensifies the momentum of the mixture of the air and the cleaning liquid; thus ejecting the mixture in impulse wave form.

The coaxial dispositions of the case 19 and the exhaust tube 24 in accordance with the above-explained second embodiment provide smoother liquid flow between the case 19 and the exhaust tube 24 than in the first embodiment. This results in causing the fluid having ejected from the ejection nozzle 60 and collided with the object being cleaned to be introduced to the exhaust tube 24 smoothly.

The above-explained ejection gun 4 ejects the air supplied by the compressor 2 from the tip of the ejection nozzle 60 through the space 63 between the outer nozzle 61 and the inner nozzle 62. The ejected air causes the ejection nozzle 60 to swing along the guide 18 and causes the liquid to be suctioned from the liquid reservoir 70 via the inner nozzle 62, thereby mixing and ejecting the sucked liquid with the air. Therefore, the present embodiment eliminates the need for a liquid-supply source for compressing and supplying the liquid.

Figure 4:
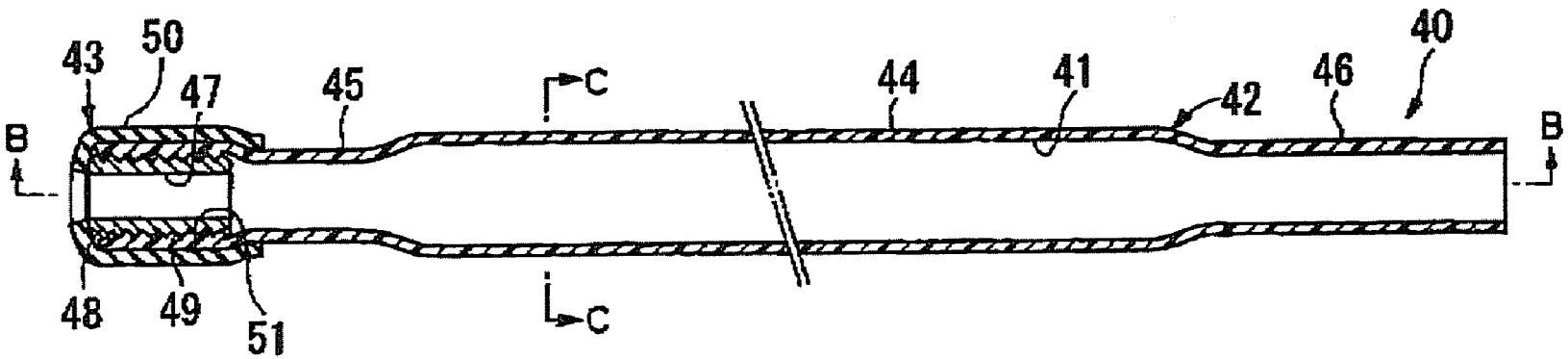
FIG. 4 shows an aspect the ejection nozzle according to each embodiment of the present invention.
Figure 5:
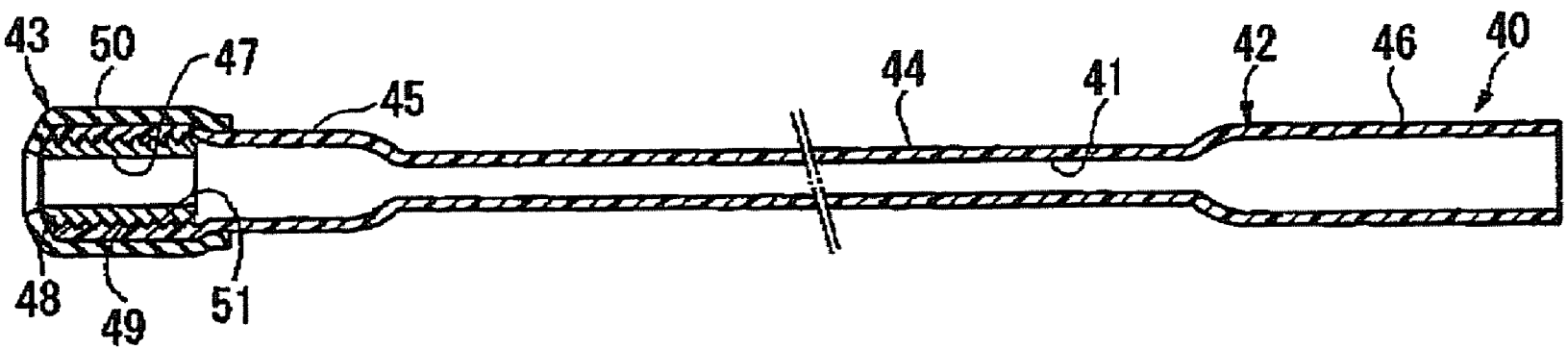
FIG. 5 is a cross sectional view taken along a line B-B of FIG. 4.
Figure 6:
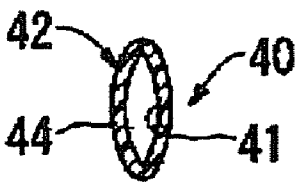
FIG. 6 is a cross sectional view taken along a line C-C of FIG. 4.

Meanwhile, a fluid ejection nozzle 40 illustrated in FIGS. 4 to 6 may replace of the ejection nozzle 13 or the ejection nozzle 60 in accordance with the above-explained embodiments. As illustrated in FIGS. 4 to 6, the fluid ejection nozzle 40 is provided with a cylindrical nozzle main body 42 and a weighted section 43 disposed to an end of the nozzle main body 42. The nozzle main body 42 is made from plastic material, e.g., nylon, Teflon (Trade Mark Registered), polyurethane, or polypropylene. The nozzle main body 42 is formed to have a substantially constant thickness. The nozzle main body 42 has a through-hole 41 passing therethrough in the longitudinal direction of the nozzle main body 42. A compressed section 44 is formed over a predetermined middle range of the nozzle main body 42 except for both ends of the nozzle main body 42. The width of the compressed section 44 in a direction orthogonal with the longitudinal direction is shorter than another width of the compressed section 44 in the direction orthogonal to both the former orthogonal direction and the longitudinal direction. Cylindrical sections 45 and 46 are provided to predetermined ranges of both ends of the nozzle main body 42. Meanwhile, in the present invention, it should be noted that the compressed shape of the compressed section 44 should not be deformed if the nozzle main body 42 extends straightforward in the longitudinal direction.

The weighted section 43 includes a screw member 48 screwed into the cylindrical section 45; and a cylindrical cap member 50 having the cylindrical section 45 screwed thereinside. A substantially cylindrical through-hole 47 formed in the center of the weighted section 43 passes therethrough in the axial line direction. A male-thread section 49 is further formed on an outer periphery of the cylindrical section over the entire length.

The screw member 48 is made from metal material. The cap member 50 is made from elastic material, e.g., silicone. Since the screw member 48 is screwed into the female-thread section 51 that has been previously formed on an inner surface of the cylindrical section 45, the removal from the nozzle main body 42 of the weighted section 43 can be prevented. Alternatively, the female-thread section 51 may not be formed on an inner surface of the cylindrical section 45, that is, the weighted section 43 may be fixed to the nozzle main body 42 with a force caused by the deformation of a cylindrical section of the screw member 48 screwed into the cylindrical section 45.

Since the inner diameter of an opening of the cap member 50 is smaller than the outer diameter of the cylindrical section 45 onto which the screw member 48 is screwed, the force caused by the deformation of the cap member 50 into which the cylindrical section 45 is fitted prevents the removal of the cap member 50 from the cylindrical section 45. Since the cylindrical section 45 is fitted onto the screw member 48 so that a part of the cylindrical section 45 does not fit to an end of the cap member 50, the cylindrical section 45 making use of its extendability covers the tip of the screw member 48 to the extent that the cylindrical section 45 does not reach to the through-hole 47 of the screw member 48.

The above-explained fluid ejection nozzle 40 ejects the fluid supplied by the compressor 2 from the tip of the fluid ejection nozzle 40 through the inner surface of the fluid ejection nozzle 40, thereby causing a turbulence of the fluid in the fluid ejection nozzle 40 because the cross sectional shapes of the cylindrical sections 45 and 46 and the compressed section 44 vary and because the liquid itself vibrates. Therefore, the influence of the turbulence or the ejecting force of the fluid provides the compressed section 44, made from flexible material, of the fluid ejection nozzle 40 with a reciprocal movement while the compressed section 44 bends in its compressed direction. This provides automatic reciprocal movement to the tip of the fluid ejection nozzle 40, thereby ejecting the fluid in wide range. In addition, since the high-speed reciprocal movement of the fluid ejection nozzle 40 amplifies pressure wave of the fluid, thereby generating a swath of strong impulse from the pressure wave of the fluid, thus more significant ejecting force can be obtained.

It should be noted that the present invention is not limited to the above-explained embodiments. That is, a vacuum apparatus, e.g., a vacuum cleaner, may be connected to a filter attachment section of the exhaust tube to suck dust, etc.

Instead of the fluid that were explained as air and water used in the above-explained embodiments, detergent or organic solvent may be used.

Although the present invention has been described with respect to its preferred embodiments, the present invention is not limited to the embodiments described above. The configuration of the present invention allows for addition, omission, substitution and further modification without departing from the spirit and scope of the present invention. The present invention is not limited to the above descriptions but is limited only by the appended claims.

INDUSTRIAL APPLICABILITY

The present invention provides a fluid ejection gun that includes: a flexible ejection tube for ejecting a fluid, the fluid being supplied to the inside of the ejection tube, the fluid being ejected from the tip of the ejection tube; a guide disposed to surround the ejection tube and introduce the ejection tube along the inner surface of the guide, the ejection tube being moved by the fluid ejected from the tip of the ejection tube; a casing disposed to surround the guide, the casing having an opening section forward in the ejection direction of the fluid ejected from the tip of the ejection tube; and a suction unit provided to the casing for sucking the fluid ejected from the ejection tube. The fluid ejection gun of the present invention can brush dirt or dust from the object being cleaned effectively.

The invention claimed is:

1. A fluid ejection gun for ejecting a fluid in an ejection direction, the fluid ejection gun comprising:

a flexible ejection tube for ejecting the fluid, the fluid being supplied to the inside of the ejection tube, the fluid being ejected from the tip of the ejection tube;

a guide disposed to surround the ejection tube and introduce the ejection tube along the inner surface of the guide, the ejection tube being moved by the fluid ejected from the tip of the ejection tube;

a casing disposed to surround the guide, the casing having an opening section forward in the ejection direction of the fluid ejected from the tip of the ejection tube; and a suction unit provided to the casing for sucking the fluid ejected from the ejection tube;

wherein the suction unit comprises an exhaust tube communicating to the casing, the exhaust tube extending from the casing and bending to extend backward relative to the ejection direction.

2. A fluid ejection gun according to claim 1, wherein the suction unit further comprises a dust-collecting unit communicating to the exhaust tube for collecting dust in the fluid, and the suction unit supplies a part of the fluid from the inside of the ejection tube to the dust-collecting unit in the exhaust tube.

3. A fluid ejection gun according to claim 1, wherein a plurality of guide bodies are disposed on an outer circumference of the ejection tube at a predetermined interval along the longitudinal direction of the ejection tube.

4. A fluid ejection gun according to claim 1, wherein the ejection tube is provided with an outer nozzle and an inner nozzle inserted through the outer nozzle; and a plurality of weighted sections are fixed on outer peripheries of the outer nozzle, and a rotative guide body is disposed between the weighted sections.

5. A cleaning apparatus for ejecting a fluid in an ejection direction, the cleaning apparatus comprising:

a flexible ejection tube for ejecting the fluid, the fluid being supplied to the inside of the ejection tube, the fluid being ejected from the tip of the ejection tube;

a fluid-pumping unit for pumping the fluid to the inside of the ejection tube;

a guide disposed to surround the ejection tube and introduce the ejection tube along the inner surface of the guide, the ejection tube being moved by the fluid ejected from the tip of the ejection tube;

a casing disposed to surround the guide, the casing having an opening section forward in the ejection direction of the fluid ejected from the tip of the ejection tube; and a suction unit provided to the casing for sucking the fluid ejected from the ejection tube;

wherein the suction unit comprises an exhaust tube communicating to the casing, the exhaust tube extending from the casing and bending to extend backward relative to the ejection direction.

6. A fluid ejection gun according to claim 5, wherein the suction unit further comprises a dust-collecting unit communicating to the exhaust tube for collecting dust in the fluid, wherein the suction unit supplies a part of the fluid from the inside of the ejection tube to the dust-collecting unit in the exhaust tube.

7. A cleaning apparatus according to claim 5, wherein the suction unit further comprises a dust-collecting unit communicating to the exhaust tube for collecting dust in the fluid, and the suction unit ejects a part of the fluid passing through the inner periphery side of the ejection tube to the dust-collecting unit in the ejection tube.

8. A cleaning apparatus according to claim 5, wherein a plurality of guide bodies are disposed on an outer circumference of the ejection tube at a predetermined interval along the longitudinal direction of the ejection tube.

9. A cleaning apparatus according to claim 5, wherein the ejection tube is provided with an outer nozzle and an inner nozzle inserted through the outer nozzle; and a plurality of weighted sections are fixed on outer peripheries of the outer nozzle, and a rotative guide body is disposed between the weighted sections.

* * * * *